US007152344B2

(12) United States Patent
Yoo

(10) Patent No.: US 7,152,344 B2
(45) Date of Patent: Dec. 26, 2006

(54) ANTI-SKID BOOT HAVING CRAMPON

(76) Inventor: Ho Moon Yoo, 648-11, Yeoksam 1-dong, Kangnam-ku, Seoul (KR)

( * ) Notice: Subject to any disclaimer, the term of this patent is extended or adjusted under 35 U.S.C. 154(b) by 101 days.

(21) Appl. No.: 11/103,841

(22) Filed: Apr. 12, 2005

(65) Prior Publication Data

US 2005/0229434 A1 Oct. 20, 2005

(30) Foreign Application Priority Data

Apr. 16, 2004 (KR) ..... 20-2004-0010569

(51) Int. Cl.
*A43C 15/06* (2006.01)

(52) U.S. Cl. ..... 36/61; 36/59 R

(58) Field of Classification Search ..... 36/61, 36/59 R

See application file for complete search history.

(56) References Cited

U.S. PATENT DOCUMENTS 1,592,571 A * 7/1926 Shull et al. ..... 36/7.6
3,685,173 A * 8/1972 Piazza ..... 36/7.6
4,480,396 A * 11/1984 Lowe et al. ..... 36/7.6
6,389,714 B1 * 5/2002 Mack ..... 36/61

FOREIGN PATENT DOCUMENTS

FR 2567004 A1 * 1/1986

* cited by examiner

*Primary Examiner*—Ted Kavanaugh
(74) *Attorney, Agent, or Firm*—Egbert Law Offices

(57) ABSTRACT

The anti-skid boot, having a crampon, is provided with both an outer sole and a boot body. The anti-skid boot includes a crampon which is provided around an outer surface of a front part of the outer sole. The crampon includes a plurality of triangular protrusions, a plurality of oblique slots and a locking notch. The anti-skid boot further includes a plate spring which is provided between the crampon and the outer sole. The anti-skid boot further includes a plurality of support pins which is fastened to the outer surface of the outer sole after passing through the plurality of oblique slots, and a locking hook which is rotatably coupled to a predetermined position of the outer surface of the outer sole adjacent to each of the opposite ends of the crampon.

2 Claims, 6 Drawing Sheets

ANTI-SKID BOOT HAVING CRAMPON

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to anti-skid boots having crampons and, more particularly, to an anti-skid boot having a crampon which has a structure capable of protruding the crampon downwards from the bottom of the anti-skid boot by a simple manipulation at need and returning the crampon to the original state to use the anti-skid boot as a typical footwear on level ground, thus being used regardless of the type of ground, for example, level ground or an icy route.

BACKGROUND OF THE INVENTION

Generally, crampons are a kind of mountain-climbing equipment, attached to the bottoms of mountain-climbing boots to prevent slipping when climbing or descending an ice ridge or walking on ice or snow. Crampons are classified into two types: hinged and rigid. A hinged type crampon is bendable at an intermediate portion thereof like a hinge. A rigid type crampon is integrated into a single body. Furthermore, the hinged type crampons are used for climbing areas including both rock walls and ice walls. The rigid type crampons are used for climbing areas comprised solely of ice, for example, frozen waterfalls. Typically, the crampons have four, six, eight, ten, twelve or fourteen points. Crampons with four or six points are used for general mountain-climbing. Crampons with twelve or more points are used for climbing ice walls.

The basic method of walking with mountain-climbing boots having such crampons is to place the feet of a user flat on an ice surface. However, recently, according to the development of crampons, the method of walking with crampons is changing. When a user climbs an ice wall with crampons, the toes of the boots are turned outwards and the sole of each boot faces downwards, so as to evenly stick the points of the crampons into ice or snow. Thereby, the user is able to maintain his/her balance and can walk comfortably and safely.

Such crampons are used for climbing steep ice or snowy routes, but they are not suitable for walking on level ground. Therefore, only when climbing steep ice or snowy routes are the crampons attached to mountain-climbing boots; when they are unnecessary, a user must remove the crampons from the mountain-climbing boots and keep them separately.

Thus, conventional arts are disadvantageous in that a user must carry separable crampons in a knapsack when climbing a mountain in the winter.

Furthermore, conventional crampons are tied to the bottom of mountain-climbing boots with straps. Accordingly, on a mountain in the winter, it is very inconvenient to tie the crampons to the mountain-climbing boots for climbing ice or snowy routes and to remove the crampons from the boots when they are unnecessary.

BRIEF SUMMARY OF THE INVENTION

The inventor of the present invention has noticed that animals belonging to the cat family have claws performing the same functions as crampons, and the claws are formed only at the front of the paws and protrude outwards from the paws to prevent slipping when climbing to high places, but they are sheathed in the paws on level ground, and, thus, the inventor has proposed the present invention.

Accordingly, the present invention has been made keeping in mind the above problems occurring in the prior art, and an object of the present invention is to provide an anti-skid boot having a crampon which has a structure capable of protruding the crampon downwards from the bottom of the anti-skid boot by a simple manipulation at need and returning the crampon to its original state to use the anti-skid boot as typical footwear on level ground, thus being used regardless of the type of ground, for example, level ground or an icy route, and in which it is unnecessary to wear and take off separate crampons or keep them separately, thus being convenient to a user.

In order to accomplish the above object, the present invention provides an anti-skid boot provided with both an outer sole and a boot body, including a crampon, having a band shape, provided around an outer surface of a front part of the outer sole, the crampon including a plurality of triangular protrusions provided under a lower end of the crampon; a plurality of oblique slots formed at predetermined positions in the crampon; and a locking notch provided on each of opposite ends of the crampon; a plate spring, having a band shape, provided between the crampon and the outer sole such that a first end of the plate spring is welded to the inner surface of the crampon near a side portion of the front part of the outer sole and a second end of the plate spring is placed in front of the front part of the outer sole; a plurality of support pins fastened to the outer surface of the outer sole after passing through the plurality of oblique slots; and a locking hook rotatably coupled by a hinge shaft to a predetermined position on the outer surface of the outer sole adjacent to each of the opposite ends of the crampon, so that the locking hook may be hooked to the locking notch of each of the opposite ends of the crampon.

The anti-skid boot further includes a first coupling hole formed at a predetermined position through the crampon, a second coupling hole formed on the outer surface of the outer sole at a position corresponding to the first coupling hole, and a coupling pin fastened to the second coupling hole of the outer sole after passing through the first coupling hole of the crampon during use of the crampon.

BRIEF DESCRIPTION OF THE SEVERAL VIEWS OF THE DRAWINGS

The above and other objects, features and advantages of the present invention will be more clearly understood from the following detailed description taken in conjunction with the accompanying drawings.

DETAILED DESCRIPTION OF THE INVENTION

Hereinafter, preferred embodiments of the present invention will be described in detail with reference to the attached drawings.

Figure 1A:
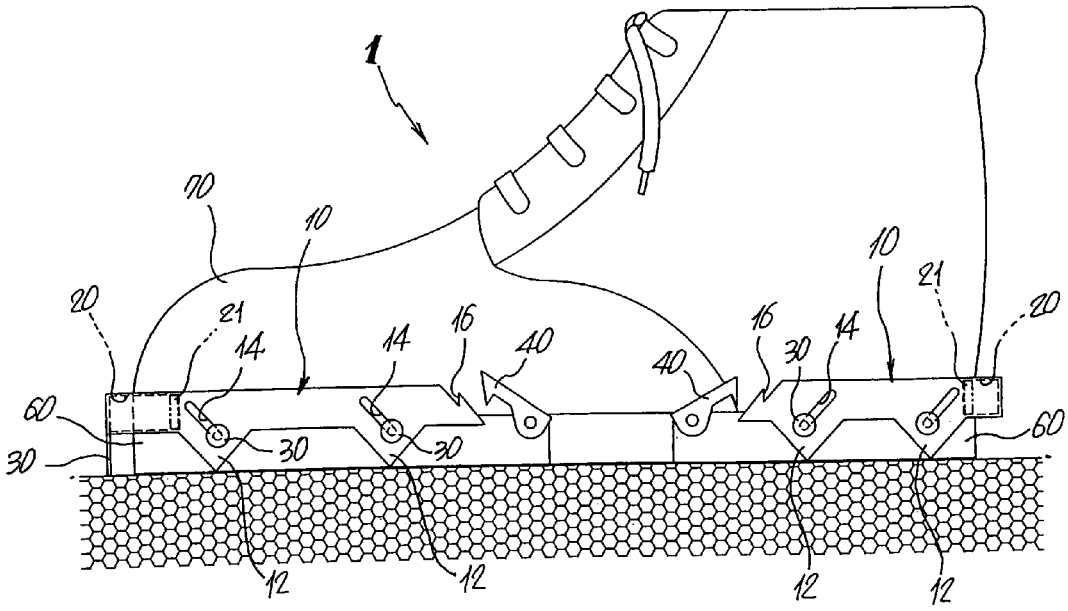
FIG. 1*a* is a side elevation view of an anti-skid boot having a crampon, according to a first embodiment of the present invention.
Figure 1B:
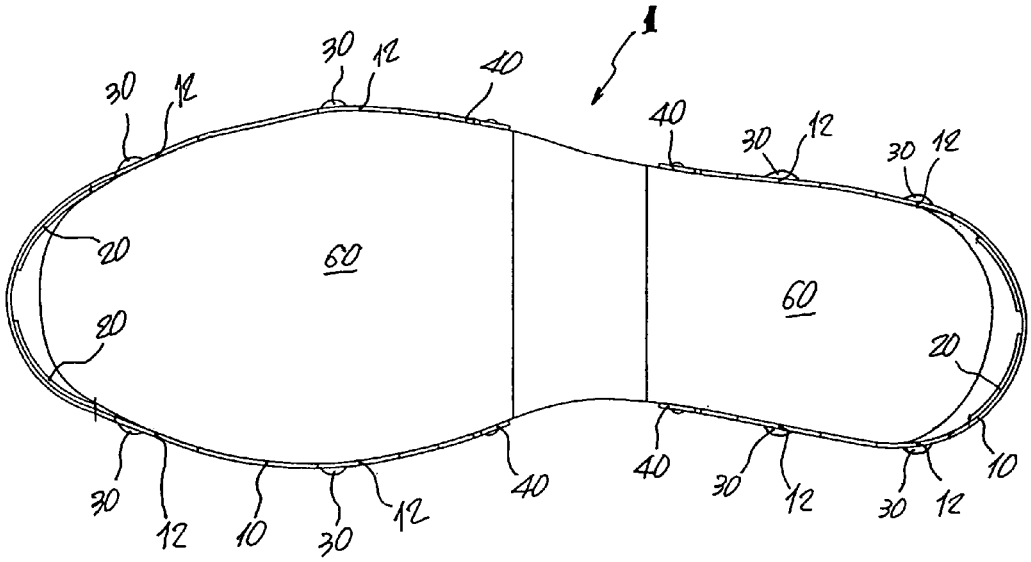
FIG. 1*b* is a bottom view of FIG. 1*a*.
Figure 2A:
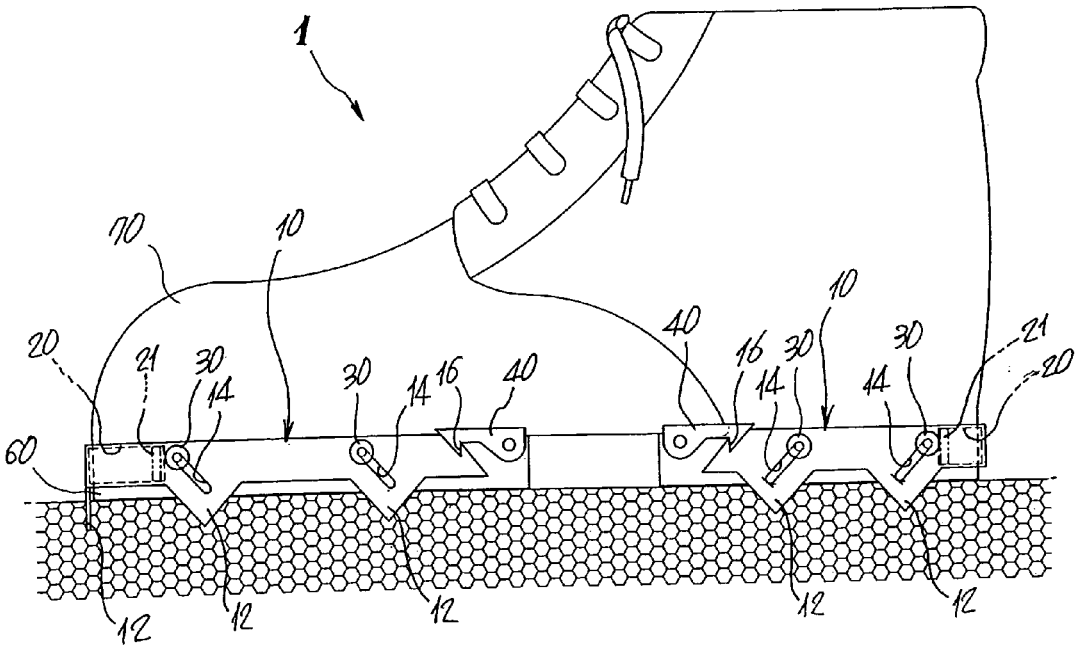
FIG. 2*a* is a side elevation view showing the anti-skid boot of FIG. 1*a* during use of the crampon.
Figure 2B:
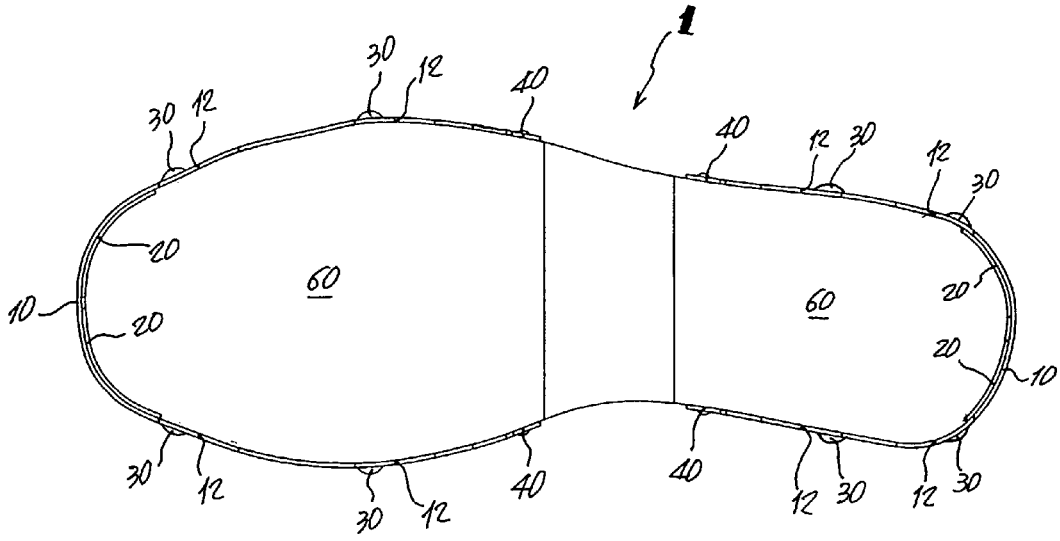
FIG. 2*b* is a bottom view of FIG. 2*a*.

FIG. 1*a* is a side view of an anti-skid boot 1 having a crampon 10, according to a first embodiment of the present invention. FIG. 1*b* is a bottom view of FIG. 1*a*. FIG. 2*a* is a side view showing the anti-skid boot 1 of FIG. 1*a* during use of the crampon 10. FIG. 2*b* is a bottom view of FIG. 2*a*.

As shown in the drawings, the anti-skid boot 1 of the present invention includes a crampon 10, a plate spring 20, a plurality of support pins 30 and a locking hook 40. The crampon 10, which has a band shape and is made of metal, is provided around the outer surface of a front part of the edge of an outer sole 60 of the anti-skid boot 1. The crampon 10 has a plurality of triangular protrusions 12 which are provided along the lower edge of the crampon 10, a plurality of oblique slots 14 which are formed at predetermined positions in the crampon 10, and a locking notch 16 which is provided on each of opposite ends of the crampon 10. The plate spring 20 having a band shape is provided between the crampon 10 and the outer sole 60 such that a first end of the plate spring 20 is welded to an inner surface of the crampon 10 near a side portion of the front part of the outer sole 60 and a second end of the plate spring 20 is placed in front of the front part of the outer sole 60. The support pins 30 are fastened to the outer surface of the outer sole 60 after passing through the plurality of oblique slots 14. The locking device 40 is rotatably coupled by a hinge shaft to a predetermined position of the outer surface of the outer sole 60 adjacent to each of the opposite ends of the crampon 10, so that the locking hook 40 is hooked to the locking notch 16 of each of the opposite ends of the crampon 10.

Of course, the crampon 10 is made of a metal plate which does not rust and has superior strength, so that the triangular protrusions 12 do not easily wear.

The anti-skid boot 1 of the present invention may further include a first coupling hole 18 which is formed at a predetermined position through the crampon 10, a second coupling hole 62 which is formed on the outer surface of the outer sole 60 at a position corresponding to the first coupling hole 18, and a coupling pin 50 which is fastened to the second coupling hole 62 of the outer sole 60 after passing through the first coupling hole 80 of the crampon 10 during use of the crampon 10.

The operation of the anti-skid boot 1 of the present invention will be explained herein below.

If a user encounters a slippery icy route while climbing a mountain with the anti-skid boots 1 in the state of FIG. 1, the user applies the crampon 10, which protrudes forwards from the front part of each boot body 70, to a hard portion such as a stone and pushes the boot body 70 against the stone. Then, the crampon 10 slides downwards and backwards along the oblique slots 14 guided by the support pins 30 of the outer sole 60. Thereafter, as shown in FIG. 2*a*, the user rotates the locking hooks 40, coupled to the outer sole 60, to hook them to the locking notches 16 formed on the opposite ends of the crampon 10.

Here, because the plate spring 20, the first end of which is welded at a welding portion 21 to the crampon 10, is provided between the crampon 10 and the boot body 70, the crampon 10 is always biased outwards from the boot body 70 by the restoring force of the plate spring 20.

In the above state, if the user walks on an icy route or climbs an ice ridge, the plurality of triangular protrusions 12 of the crampons 10 which protrude downwards from the outer soles 60 sticks into the ice or soil and, thus, prevents the boot bodies 70 from slipping.

In particular, the triangular protrusions 12 of the crampons 10, which are provided around the front parts of the outer soles 60 of the anti-skid boots 1 of the present invention, can more effectively support the user's body when walking, and more reliably prevent the boots 1 from slipping, compared with conventional crampons provided under central portions of outer soles of boots.

Preferably, the plurality of triangular protrusions 12 of the crampon 10 is concentrated on a front end portion of the front part of the outer sole 60 such that the triangular protrusions 12 may stick firmly into the ice or ground, thus promoting the stability during walking.

The crampon 10 of the anti-skid boot 1 of the present invention having the above-mentioned structure may be provided around only the front part of the outer sole 60 of the boot body 70. Alternatively, as shown in FIGS. 1*a* and 2*a* showing the first embodiment, a pair of crampons 10 having the same structure may be provided around the front and rear parts of the outer sole 60.

When the user, who has used the crampons 10 of the anti-skid boots 1 of the present invention, encounters usual terrain along his/her way and, thus, when the crampons 10 become unnecessary, the user unlocks the locking hooks 40, which hold the crampons 10, from the locking notches 16 of the opposite ends of each crampon 10.

Then, the crampon 10 protrudes forwards from the boot body 70 due to the elasticity of the plate spring 20 which is provided between the boot body 70 and the crampon 10 to bias the crampon 10 outwards from the boot body 70. The crampon 10 moves forwards and upwards on the support pins 30 fastened to the outer sole 60, until each support pin 30 reaches a lower end of the oblique slot 14.

As such, the crampon 10 moves forwards and upwards from the bottom of the outer sole 60 at need and is placed around the outer surface of the boot body 70. Thereby, as shown in FIG. 1*a*, the triangular protrusions 12 provided under the lower end of the crampon 10 are above the bottom of the outer sole 60. Therefore, the crampon 10 does not interfere with walking on level ground.

Figure 3A:
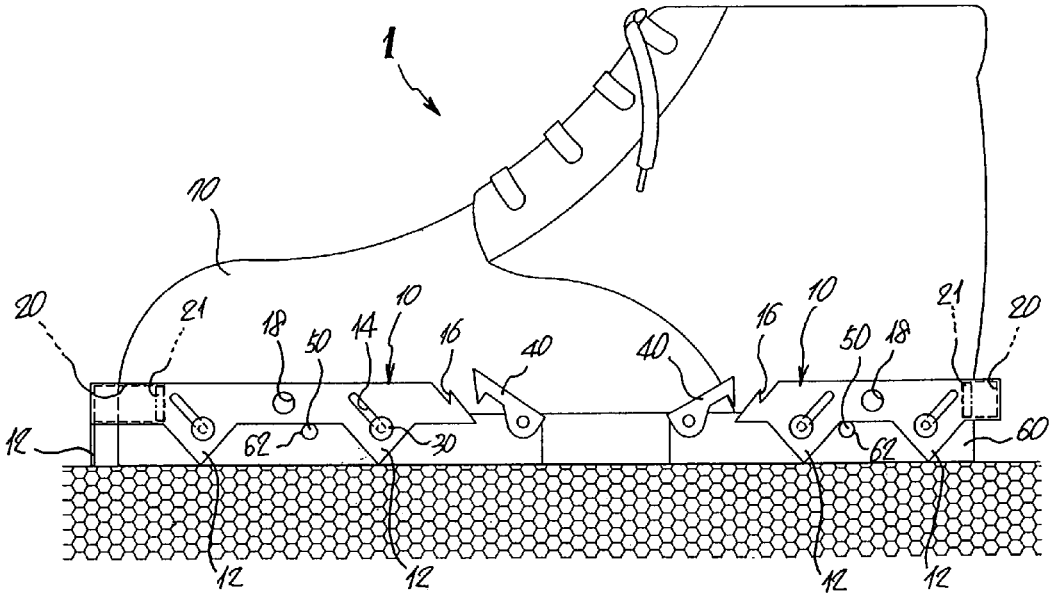
FIG. 3*a* is a side elevation view showing an anti-skid boot, the crampon of which is not in use, according to a second embodiment of the present invention.
Figure 3B:
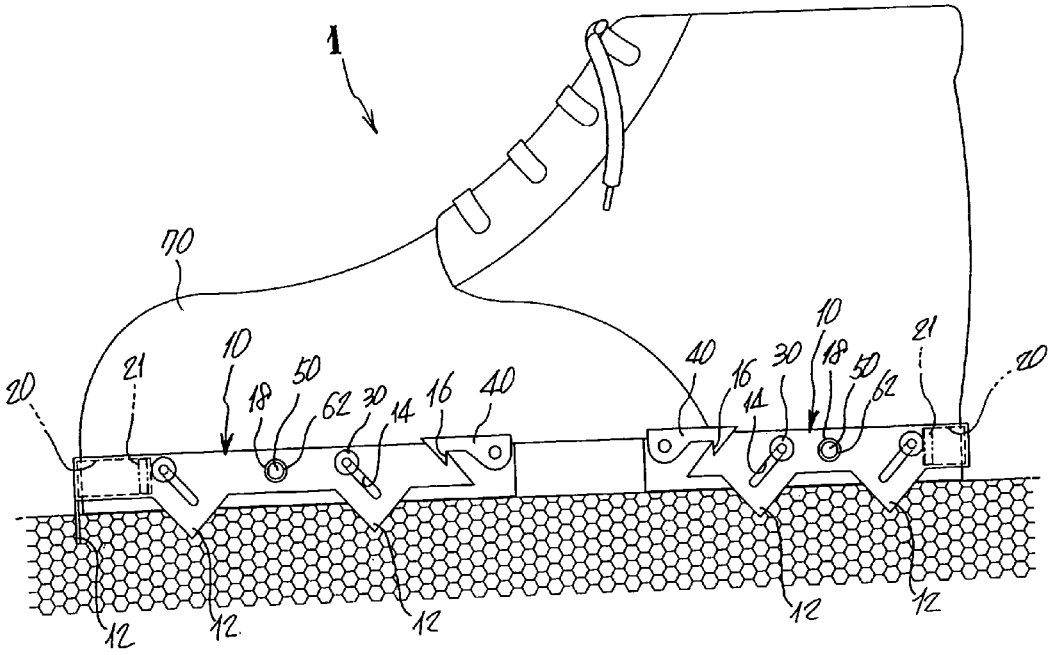
FIG. 3*b* is a side elevation view showing the anti-skid boot of FIG. 3*a* during use of the crampon.

FIG. 3*a* is a side view showing an anti-skid boot 1 before a crampon 10 is used, according to a second embodiment of the present invention. FIG. 3*b* is a side view showing the anti-skid boot 1 of FIG. 3*a* during use of the crampon 10. In the second embodiment, as shown in FIGS. 3*a* and 3*b*, a first coupling hole 18 is formed at a predetermined position through a crampon 10. A second coupling hole 62 is formed on the outer surface of an outer sole 60 at a position corresponding to the first coupling hole 18. A coupling pin 50 is fastened to the second coupling hole 62 of the outer sole 60 after passing through the first coupling hole 18 of the crampon 10 during use of the crampon 10. Thus, the crampon 10 does not move and is reliably fastened to the outer sole 60.

In the anti-skid boots 1 having the crampons 10 according to the present invention, it is unnecessary for the user to carry a separate crampon. At need, the crampons 10 protrude downwards from the outer sole 23 or retract to their original state, thus being convenient to the user.

As described above, the present invention provides an anti-skid boot having a crampon in which the crampon is normally located around an outer sole to allow a user to walk on level ground, and may be protruded downwards from the outer sole by only a simple manipulation at need. Therefore, the present invention makes it easy for the user to climb a mountain in the winter regardless of the type of ground, for example, level ground or an icy route. Furthermore, it is unnecessary to put on and take off separate crampons or to keep them separately.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

I claim:

1. An anti-skid boot with both an outer sole and a boot body, said anti-skid boot comprising:

a crampon, having a band shape, provided around an outer surface of a front part of the outer sole, the crampon comprising:

a plurality of triangular protrusions provided under a lower end of the crampon;

a plurality of oblique slots formed at predetermined positions in the crampon; and a locking notch provided on each of opposite ends of the crampon;

a plate spring, having a band shape, provided between the crampon and the outer sole such that a first end of the plate spring is welded to the inner surface of the crampon near a side portion of the front part of the outer sole and a second end of the plate spring is placed in front of the front part of the outer sole;

a plurality of support pins fastened to the outer surface of the outer sole after passing through the plurality of oblique slots; and a locking hook rotatably coupled by a hinge shaft to a predetermined position on the outer surface of the outer sole adjacent to each of the opposite ends of the crampon, the locking hook being hooked to the locking notch of each of the opposite ends of the crampon.

2. The anti-skid boot as set forth in claim 1, further comprising:

a first coupling hole formed at a predetermined position through the crampon;

a second coupling hole formed on the outer surface of the outer sole at a position corresponding to the first coupling hole; and a coupling pin fastened to the second coupling hole of the outer sole after passing through the first coupling hole of the crampon during use of the crampon.

* * * * *